United States Patent [19]

Friesen

[11] Patent Number: 4,522,248

[45] Date of Patent: Jun. 11, 1985

[54] SEGMENTED MOLD WEIGHT AND COMBINATION WITH MOLD JACKET

[75] Inventor: Wilmer J. Friesen, Hutchinson, Kans.

[73] Assignee: Vulcan Engineering Co., Helena, Ala.

[21] Appl. No.: 409,358

[22] Filed: Aug. 19, 1982

[51] Int. Cl.[3] ..... B22C 21/00

[52] U.S. Cl. ..... 164/394; 164/412

[58] Field of Search ..... 164/394, 395, 396, 412; 249/204, 205

[56] References Cited

U.S. PATENT DOCUMENTS

| | | | |
|---|---|---|---|
| 342,882 | 6/1886 | Smith | 164/312 |
| 2,039,872 | 5/1936 | Aldrich | 249/204 |
| 2,185,390 | 1/1940 | Aldrich | 249/204 |
| 2,366,581 | 1/1945 | Whittaker | 164/384 |
| 4,299,269 | 11/1981 | Friesen et al. | 164/324 |

FOREIGN PATENT DOCUMENTS

| | | | |
|---|---|---|---|
| 742844 | 3/1933 | France | 164/412 |

*Primary Examiner*—Nicholas P. Godici
*Assistant Examiner*—J. Reed Batten, Jr.
*Attorney, Agent, or Firm*—Andrus, Sceales, Starke & Sawall

[57] ABSTRACT

A mold weight for use with foundry sand molds comprises a frame assemblage including a pair of spaced frame members connected by rods. A plurality of segmental weight elements are disposed between the frame members and carried by the rods. The weight elements are further disposed to avoid the area of the mold surface that contains the down sprues. The frame members and weight elements are movable, within limits relative to the connecting rods and to each other. Weight elements are made available in a plurality of lengths so that the mold weight configuration can be varied in contemplation of sand molds requiring different down sprue locations.

6 Claims, 11 Drawing Figures

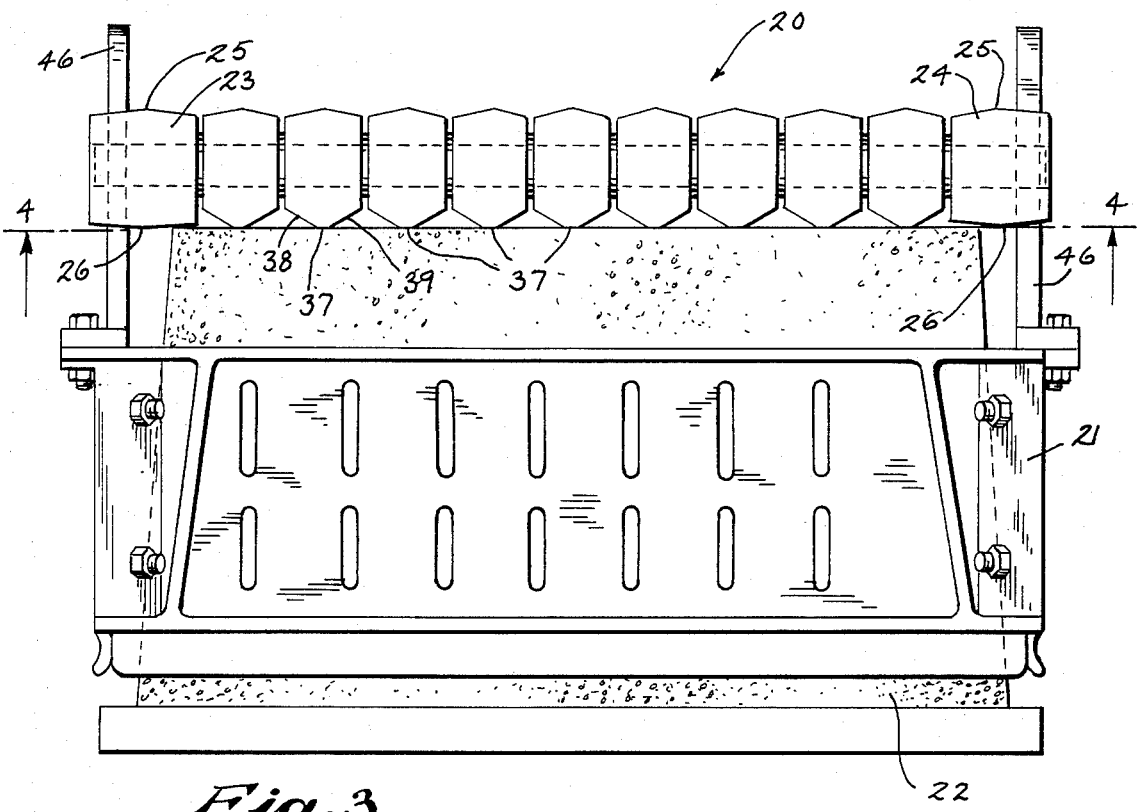
Fig. 3
Fig. 4
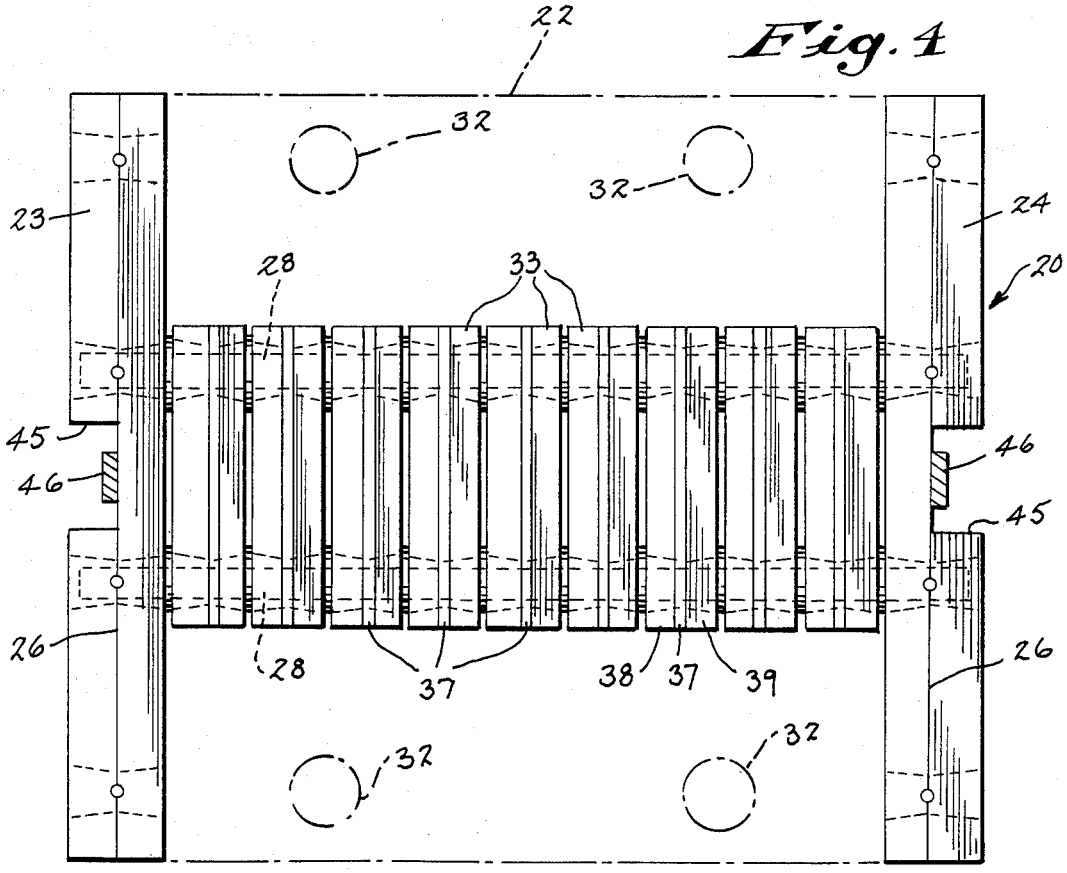

Fig. 10
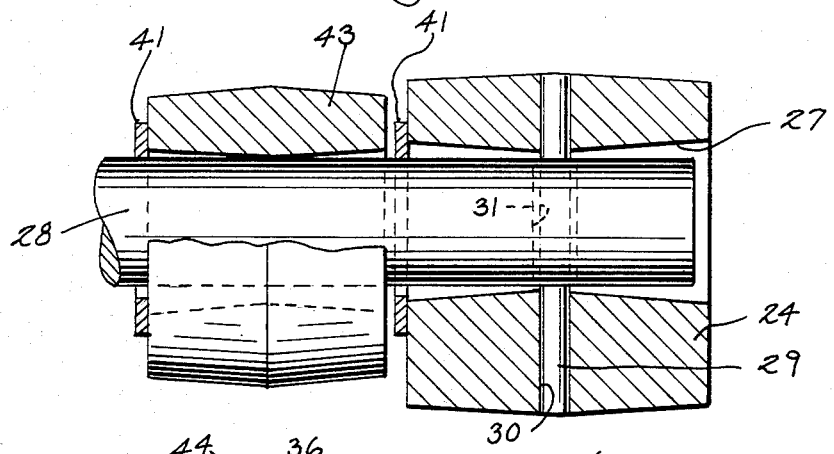
Fig. 11
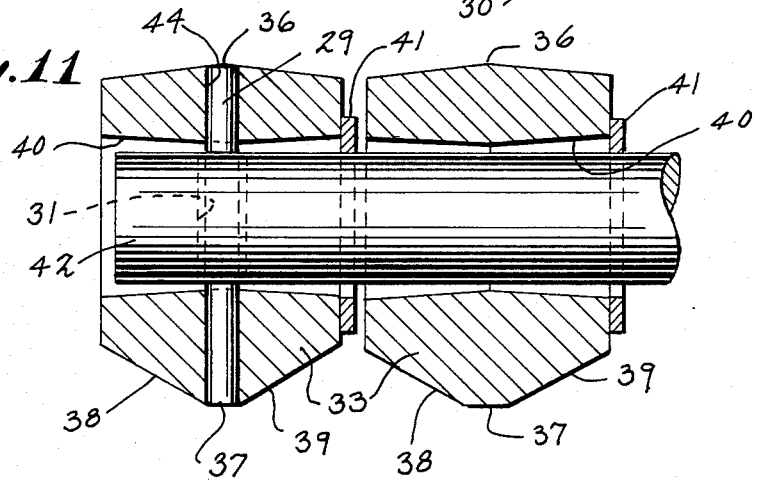
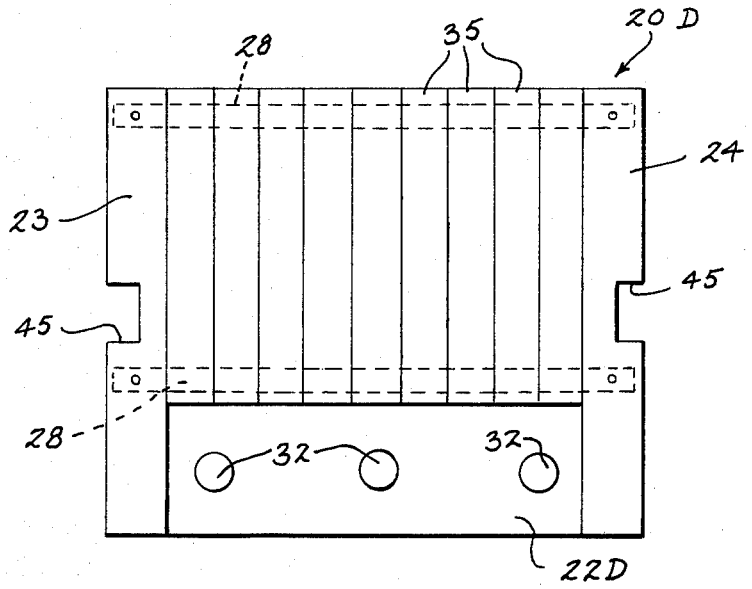
Fig. 8

SEGMENTED MOLD WEIGHT AND COMBINATION WITH MOLD JACKET

BACKGROUND OF THE INVENTION

This invention relates to weights as may be employed for foundry sand molds, and more particularly to a segmented mold weight.

The use of weights upon foundry sand molds is not uncommon to prevent the upper part or cope of the mold from welling up or breaking out when molten metal is being poured or cast to fill the mold cavity. Generally, such mold weights are flat, made in one piece, and are designed for a specific mold to have openings vertically aligned with the sprues through which the molten metal is to be poured. During the casting procedure, moisture is driven from the mold and trapped beneath the one-piece solid weight. The moisture causes sand to stick to or cake upon the engaging face of the mold weight. Unless that sand is removed, the weight may not seat properly on the next mold, allowing the cope of the mold to lift and fill all noncontacting surfaces of the weight to possibly give rise to some distortion in the resulting casting. It is generally an object of this invention to provide a segmented mold weight which is capable of "flexing" and transmission of vibration among the segments thereof to facilitate clean-off of any caked sand thereon. The mold weights of this invention are particularly adapted for use in combination with the mold jackets as disclosed in the automated foundry arrangement of U.S. Pat. No. 4,299,269 assigned to the common assignee of the present application.

SUMMARY OF THE INVENTION

The invention is directed to a segmented mold weight for use with foundry sand molds having an upper surface with at least one area of down sprues and contemplates a pair of spaced frame members. Means are provided for connecting the frame members. A plurality of segmented weight elements are disposed between the frame members and carried by the connecting means. The weight elements are further disposed to avoid the area for the down sprues. The frame members as well as the weight elements are movable, within limits, relative to each other and to the connecting means.

According to a further aspect of the invention, the weight elements are available in different lengths so that the mold weight assemblage can be varied in contemplation of a different casting requiring differing down sprue location.

DESCRIPTION OF THE DRAWING FIGURES

The drawings furnished herewith generally illustrate the best mode presently contemplated for the invention and are described hereinafter.

In the drawings:

FIG. 1 is a side elevation view of the segmented mold weight of this invention shown in combination with a mold jacket as may be employed in the foundry handling system of U.S. Pat. No. 4,299,269;

FIG. 3 is a side elevation view showing the mold weight of this invention and mold jacket in their respective positions on a foundry sand mold;

FIG. 4 is a bottom plan view of a mold weight taken generally along the line 4—4 of FIG. 3 and in dot-dash lines indicates the mold and down sprue locations;

FIGS. 5, 6, 7 and 8 are top plan views showing different mold weight configurations for accommodating different down sprue locations in the respective molds;

FIG. 10 is an enlarged sectional view taken generally on the line 10—10 of FIG. 6; and FIG. 11 is an enlarged sectional view taken generally on the line 11—11 of FIG. 6.

DESCRIPTION OF THE ILLUSTRATED EMBODIMENTS

Figure 1:
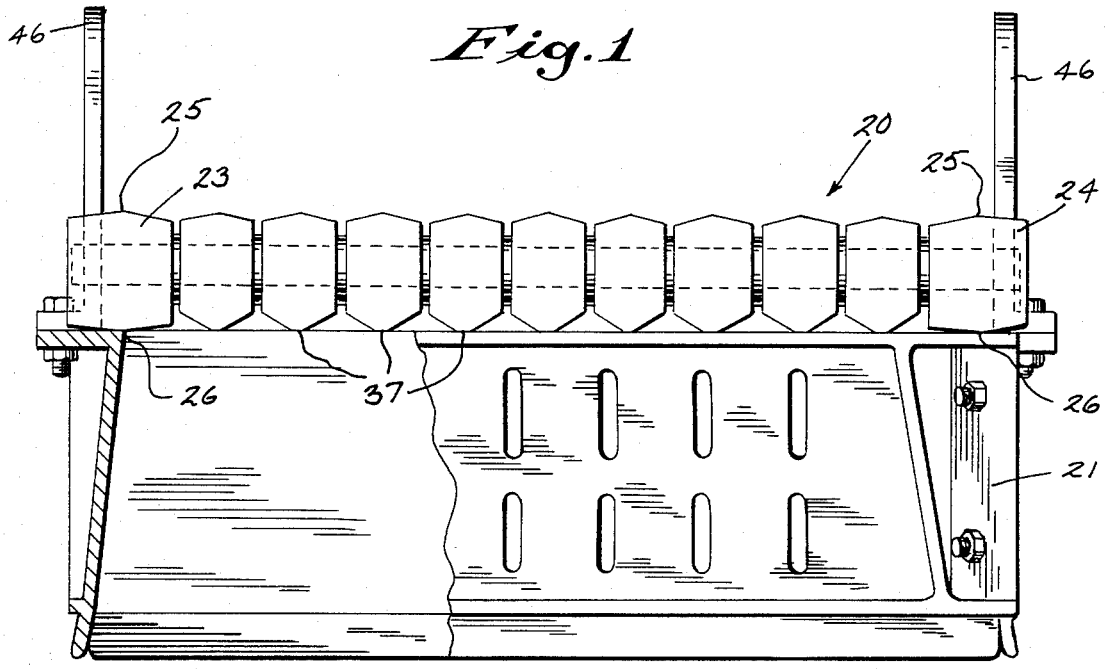

Referring to the drawings, the segmented mold weight 20 of this invention is shown and described in conjunction with a mold jacket 21. The mold jacket 21 may be of the general type employed in the automated foundry arrangement disclosed in U.S. Pat. No. 4,299,269. The mold weight 20, however, may have utility in a foundry environment apart from any automated arrangement or even a jacket to prevent the upper part or cope of a mold 22 from raising or breaking out when molten metal is being poured or cast to fill the mold cavity, not shown.

Figure 2:
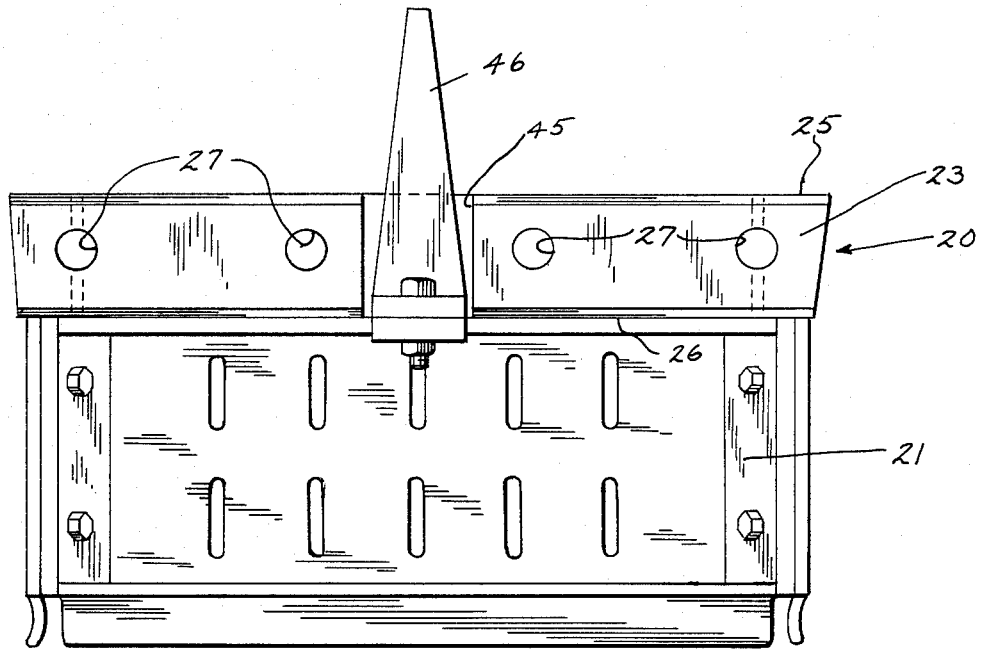
FIG. 2 is an end elevation view of the mold weight of this invention with the mold jacket.

FIGS. 1 and 2 of the drawings show the generally rectangular mold jacket 21 and the mold weight 20 when out-of-service and/or in readiness to accommodate a sand mold 22. In such circumstance, the mold weight 20 rests directly upon and is supported by the jacket 21.

The segmented mold weight 20 includes a pair of transversely spaced and aligned frame elements 23 and 24 which generally extend over the full width of the jacket 21. The top and bottom of the frame elements 23 and 24 are provided with generally shallow V-shaped projections forming top and bottom ridges 25 and 26, respectively, generally centrally of the elements, while the opposed sides of the elements extend vertically and are generally parallel.

The frame elements 23 and 24 are provided with a plurality of transversely aligned holes 27 all disposed in the same horizontal plane spaced somewhat above the horizontal plane containing the vertical center point of the elements. With reference to FIG. 2 of the drawings, four (4) holes 27 are indicated with the outer holes being spaced a given distance from the corresponding ends of the frame elements 23 and 24. The holes 27 are generally hour-glass shaped or necked down to a lesser diameter generally centrally of the frame elements 23 and 24, and are spaced equidistantly between the outer holes.

Figure 9:
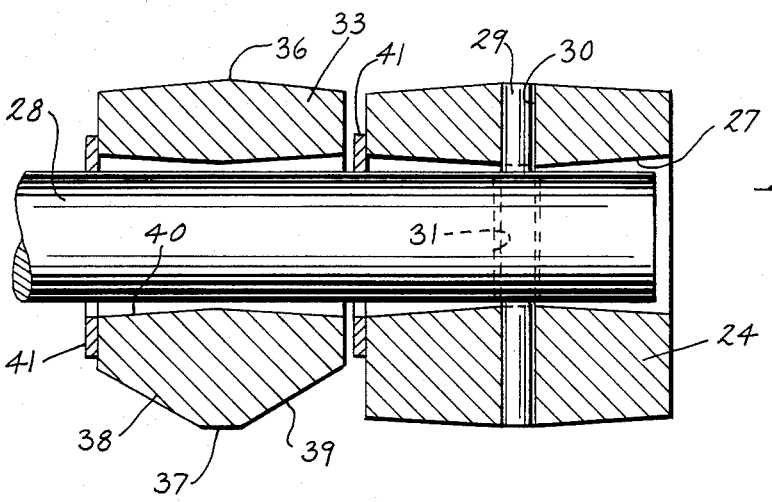
FIG. 9 is an enlarged sectional view taken generally on the line 9—9 of FIG. 5.

The transversely aligned holes 27 of the frame elements 23 and 24 are adapted to receive cylindrical rods 28 that extend between the elements. The rods 28 extend into the aligned holes 27 of the frame elements 23 and 24 with some radial clearance being provided as generally shown in FIG. 9. Securement between the frame elements 23 and 24 and the rods 28 is provided by the pins 29 which extend through the vertically aligned holes 30 and 31 generally centrally of the elements and diametrically in the rods, respectively. While the pin 29 has clearance within the hole 31 in the rod 28, it is press fit for securement within the hole 30 of the frame elements. In view of the clearances for the rod 28 within the hole 27 and for the pin 29 within the hole 31, the frame elements 23 and 24 are free to rock and otherwise move relative to the corresponding rod to a limited extent. The length of the rods 28 provide that the spaced frame elements 23 and 24 will seat on the respective ends of the mold 22 as generally shown in FIG. 3.

The frame assemblage comprising the frame elements 23 and 24 along with two (2) or more rods 28 varyingly carry segmental weight elements to form the mold weights 20 of varying configuration as shown by way of example in FIGS. 4–8. As generally shown, the various weight elements are arranged on the frame assemblage between the frame elements 23 and 24 in a manner to avoid the areas of the mold 22 that contain the down sprues 32 for receiving the molten metal during the casting operation.

Figure 5:
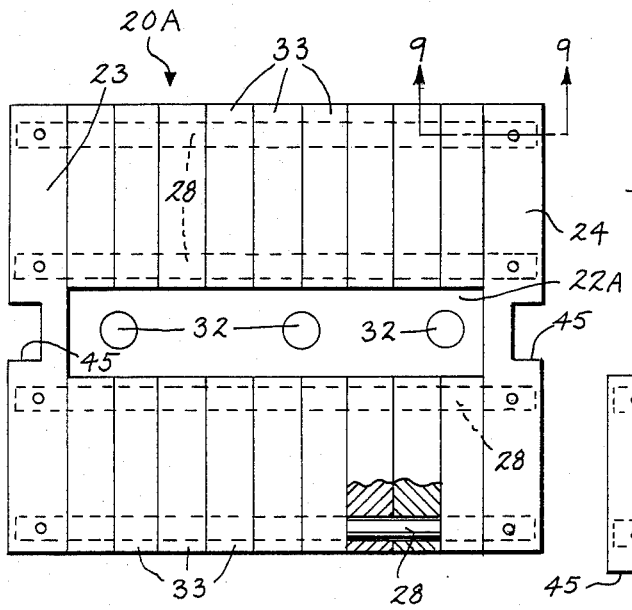
Figure 6:
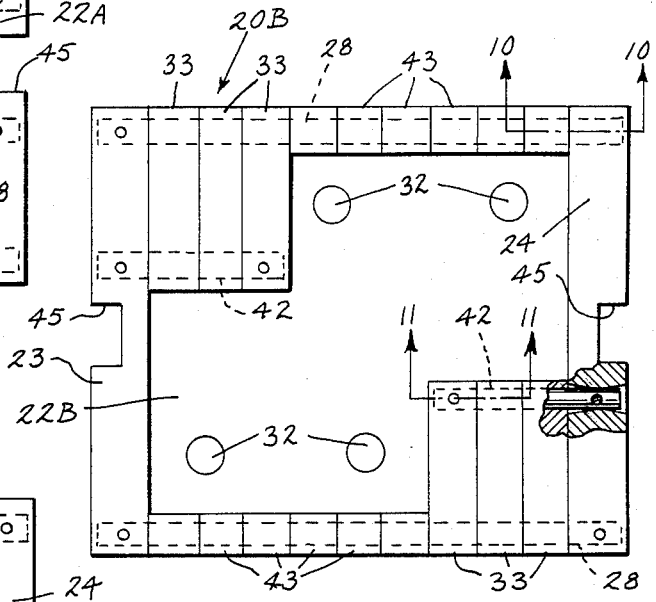
Figure 7:
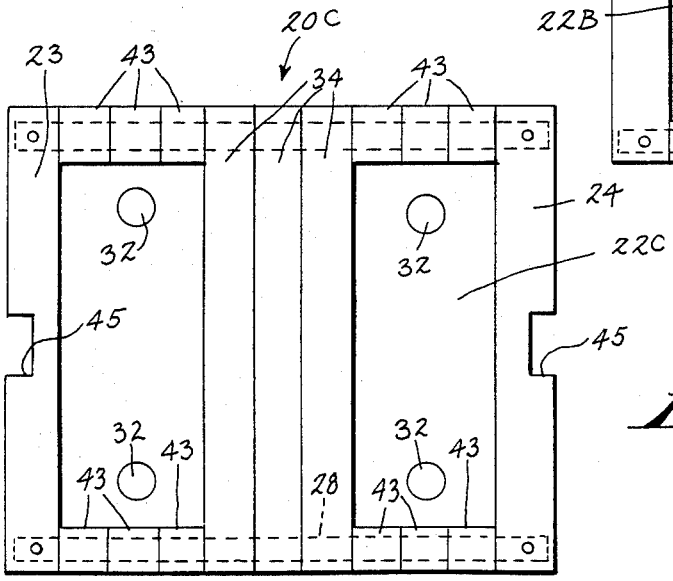

The segmental weight elements are provided in a plurality of lengths. In FIGS. 4–6, relatively short weight elements 33 are employed that extend between and are supported by a pair of rods 28 disposed in adjacent holes 27 of the frame elements 23 and 24. In FIG. 7, long weight elements 34 are employed that generally correspond in length to the frame elements 23 and 24. The weight elements 34 are supported by a pair of rods 28 disposed in the outermost holes 27 of the frame elements. In FIG. 8, intermediate length weight elements 35 are employed that extend between and are supported by a pair of rods 28 spaced two (2) holes 27 apart.

In-section, the weight elements 33, 34 and 35 are generally identical in shape having a given width and vertical and generally parallel sides. The top of elements 33, 34 and 35 is provided with a shallow V-shaped projection that forms a ridge 36 centrally that runs the full length of the respective elements. The bottom of elements 33, 34 and 35 is provided with a truncated V-shaped projection that forms a relatively narrow flat or horizontal surface 37 generally centrally between the opposed angular surfaces 38 and 39. The weight elements 33, 34 and 35 generally correspond in height to the frame elements 23 and 24 and contain a pair of spaced, transversely extending holes 40 for receiving the rods 28. The spacing between the holes 40 in the weight elements 33, 34 and 35 is a multiple of the spacing between the holes 27 of the frame elements 23 and 24 and will vary in accordance with the length of the weight elements. Like the holes 27 in the frame elements 23 and 24, the holes 40 in the weight elements 33, 34 and 35 are hourglass shaped, receive the rods 28 with some clearance, and have their axes disposed in a horizontal plane somewhat above the horizontal central plane of the weight elements. Thus, and as in the case with the frame elements 23 and 24, the weight elements 33, 34 and 35 will have their greater mass beneath the centerline of the rods 28 upon which they are carried. While the weight elements 33, 34 and 35 are free to rock about an axis generally normal to the rods 28, they will generally come to rest with the flat surface 37 disposed horizontally. As shown in the drawings, the rods 28 carry a given number of the weight elements between the spaced frame elements 23 and 24 with washers 41 interposed between the elements.

In the mold weight 20 of FIG. 4, short weight elements 33 are arranged in a single bank and carried on spaced rods 28 secured within the two (2) central holes 27 of the opposed frame elements 23 and 24 and bear down on a central portion of the mold 22 between the frame elements. The FIG. 4 mold weight configuration contemplates a mold 22, shown in dot-dash lines, wherein the down sprues 32 are spaced longitudinally adjacent to the opposed outside edges of the mold.

The mold weight 20A of FIG. 5 also utilizes the short weight elements 33. The weight elements 33 are arranged in two (2) banks along the respective sides of the mold 22A with each bank of mold elements being supported by a pair of rods 28 secured in adjacent holes 27 of the frame elements 23 and 24. In the mold weight configuration of FIG. 5, the central portion of the mold 22A intermediate the banks of weight elements 33 remains exposed and contains the longitudinally spaced down sprues 32.

The shorter weight elements 33 are also utilized in the mold weight 20B of FIG. 6 wherein diagonally opposed shortened banks of the weight elements accommodate a mold 22B having down sprues 32 longitudinally aligned with the respective banks. Each bank of the weight elements 33 in FIG. 6 is supported by a rod 28 and a shorter length of rod 42. The rod 28 for each bank of mold elements 33 is secured in the outer holes 27 of the frame elements 23 and 24, respectively. The weight elements 33 in FIG. 6 are maintained in place relative to the rod 28 by a plurality of generally cylindrical spacer elements 43 disposed on the rod between the shortened bank and the opposed frame element. The length of the spacer elements 43 generally correspond to the width of the weight elements so that the spacer elements can replace weight elements where needed to fill out the length of rod 28. While the spacer elements 43 add weight to the mold weight 20B, their radial dimension provides for the spacer elements to remain out of contact with the surface of the mold 22B when the mold weight is seated on the mold as will be apparent from FIG. 10.

The rod 42 supporting the inner end of the weight elements 33 in FIG. 6 is of generally the same diameter as the rod 28 and is provided with similar diametral holes 31 adjacent to the respective ends thereof. Thus, the rod 42 extends through the aligned holes 40 of the shortened bank of weight elements 33 and into the corresponding hole 27 of the adjacent frame element where the rod is secured to the frame element by a pin 29. The opposed end of rod 42 is secured relative to the remote or last weight element 33 of the shortened bank with a pin 29 passing through the aligned holes 44 and 31 as generally shown in FIG. 11, with pin securement being assured by a press fit relative to the hole 44.

The long weight elements 34 form a part of the mold weight 20C of FIG. 7 wherein the mold 22C contains a pair of spaced down sprues 32 generally adjacent to each of the frame elements 23 and 24. In the mold weight 20C, a shortened bank of weight elements 34 is disposed generally midway between the frame elements 23 and 24 and is supported by the spaced rods 28 respectively secured in the outermost holes 27 of the frame elements. Spacer elements 43 on the rods 28 between the respective frame elements 23 and 24 and the bank of weight elements 34 serve to positionally confine the latter relative to the rods and clear of the area for the down sprues 32.

Weight elements 35 of an intermediate length are employed in the mold weight 20D of FIG. 8 wherein the mold 22D is provided with a plurality of spaced down sprues 32 generally adjacent one side edge of the mold. In the mold weight 20D, a full complement of weight elements 35 are disposed between the spaced frame elements 23 and 24 with one of the pair of supporting rods 28 being secured in the axially aligned outer holes 27 of the respective frame elements and with the other rod being secured in the axially aligned central holes farthest removed from the first rod. As in the case of the previously described mold weights, the mold weight 20D provides for exposure of the area containing the down sprues 32.

When the segmented mold weight of this invention is used in conjunction with a mold jacket 21, the frame elements 23 and 24 are each provided with a generally rectangular, outwardly facing recess 45 generally centrally of their length. A guide post 46 is mounted centrally on each end of the jacket 21 and projects upwardly beyond the upper edge of the jacket for engagement within the corresponding recesses 45. During the inactive and/or ready state of the jacket 21 as generally shown in FIGS. 1 and 2, at least the frame elements 23 and 24 of the segmented mold weight of whatever configuration rest on the upper edge of the jacket for support. When the jacket 21 is lowered to envelope the sides of the mold, the downward movement of the segmented mold weight is initially interrupted as the mold weight engages and seats upon the upper surface of the mold. As the jacket 21 continues to move downwardly relative to the mold weight to its mold enveloping position as generally shown in FIG. 3, the guide posts 46 move relative to and remain engaged within the recesses 45.

Subsequent to the casting operation and following a desired interval for cooling, the jacket 21 and mold weight are removed from the mold. During removal, the jacket initially moves upwardly relative to the mold weight with the guide posts 46 moving upwardly relative to and within the recesses 45 as the mold weight remains at rest on the upper surface of the mold. As the jacket 21 continues upwardly, it picks up the mold weight with a desired impact to impart rocking and vibration to the weight elements and thereby loosen and clean off any sticking and caked sand picked up from the mold and thus eliminate or minimize the need for subsequent further cleaning of the mold weights. As best shown in FIG. 2, the guide posts 46 are tapered to provide a base portion having a width that generally approaches the length of the recess 45 to assure proper positioning of the mold weight relative to the jacket 21 upon pickup.

The mold weight according to this invention includes relatively few parts so that inventory and stocking remain uncomplicated. The segmental weight construction lends itself to change and change with relative ease in contemplation of a mold for a different casting requiring differing down sprue location. The weight elements themselves may be castings, and being relatively small, are produced with relative ease as compared to the more common solid, flat mold weight.

The weight elements with their truncated V-shaped lower portions make minimal but yet effective contact with the mold surface to generally prevent a welling up or breaking out of that surface with possible consequent distortion in the casting. And since the weight elements are permitted limited movement relative to their support, the weight will be generally evenly distributed even over a somewhat uneven mold surface. Moisture and gasses released from the mold during the casting or pouring operation and that would be trapped under a solid, flat mold weight to deleteriously promote sticking or caking of sand to the weight, are freely able to escape under the minimal contact condition presented by the segmented mold weight construction of this invention.

Various modes of carrying out the invention are contemplated as being within the scope of the following claims particularly pointing out and distinctly claiming the subject matter which is regarded as the invention.

I claim:

1. A mold weight and a mold jacket for use with foundry sand molds having an upper surface provided with at least one area of down sprues; said mold weight comprising a pair of spaced frame members, generally rigid means connecting said members, and a plurality of segmental weight elements disposed between the frame members and carried by the connecting means, said weight elements being further disposed to avoid the area for down sprues, said frame members and said weight elements being movable within limits relative to each other and the connecting means; said mold weight being supportable on the upper edge of the mold jacket; said mold weight and mold jacket being movable vertically relative to each other for respective engagement upon a sand mold and for subsequent removal from the sand mold; said mold jacket upon removal from the sand mold picking up the mold weight with vertical movement and imparting thereby a desired impact to the mold weight to rock and vibrate the weight elements and thereby loosen and clean off any sticking and caked sand picked up from the sand mold.

2. The structure as set forth in claim 1 wherein the mold weight and mold jacket are interlocked to provide for movement vertically relative to each other and to generally limit movement horizontally relative to each other.

3. The structure as set forth in claim 2 wherein the interlock between the mold weight and mold jacket assemblage comprises a pair of spaced guide posts on one member of said assemblage engageable within corresponding recesses in the other member of said assemblage.

4. The structure as set forth in claim 2 wherein the interlock between the mold weight and the mold jacket comprises an outwardly facing recess provided in each of the spaced frame members generally centrally of their length and which are engageable upon corresponding upwardly projecting guide posts provided upon the respective ends of the mold jacket.

5. In a mold weight for use with a foundry sand mold having an upper surface provided with at least one area of down sprues, a pair of spaced frame members, generally rigid rods connecting said members, and a plurality of segmental weight elements, said weight elements having axially aligned, transversely extending holes to provide for disposition of said elements on the connecting rods between said frame members, said weight elements being disposed to avoid the area for down sprues, said holes in the weight elements being hour-glass shaped and oversized relative to the rods to permit said elements to rock relative to the rods and each other when the mold weight is lifted from the mold.

6. In a mold weight for use with a foundry sand mold having an upper area of down sprues, a pair of spaced frame members, generally rigid rods connecting said members, and a plurality of segmental weight elements carried by the connecting rods between said frame members, said frame members being provided with a plurality of transversely extending holes that are equidistantly spaced longitudinally of said members and axially aligned between said members, said connecting rods being adapted to extend into the aligned holes of the respective frame members, said weight elements being available in a plurality of lengths to provide for varying mold weight configurations to accommodate different mold requirements relative to down sprue locations, each length of weight element having a pair of transversely extending holes and with the holes being longitudinally spaced in accordance with a multiple of the spacing of the holes in the frame members so that a pair of rods extending through the weight element holes will engage within frame member holes to provide for support of the weight elements, said holes in the frame members and weight elements being hour-glass shaped and oversized relative to the connecting rods to permit the frame members and weight elements to rock relative to the rods and each other when the mold weight is being lifted from the mold.

* * * * *